US005704155A

United States Patent [19]

Primeau, IV

[11] Patent Number: 5,704,155

[45] Date of Patent: Jan. 6, 1998

[54] UNIVERSAL TACTICAL MOUNT

[76] Inventor: Daniel F. Primeau, IV, 471 N. Forest, Williamsville, N.Y. 14221

[21] Appl. No.: 808,666

[22] Filed: Feb. 28, 1997

Related U.S. Application Data

[63] Continuation-in-part of Ser. No. 636,035, Apr. 22, 1996, abandoned.

[51] Int. Cl.[6] ..... F41G 1/34

[52] U.S. Cl. ..... 42/103; 362/110; 362/250

[58] Field of Search ..... 42/101, 103; 33/241, 33/261; 362/109, 110, 113, 114, 250

[56] References Cited

U.S. PATENT DOCUMENTS

| | | | |
|---|---|---|---|
| 1,215,171 | 2/1917 | Lewis | 356/247 |
| 2,103,539 | 12/1937 | Kuhn | 33/248 |
| 2,449,551 | 9/1948 | Garand | 33/245 |
| 4,026,054 | 5/1977 | Snyder | 42/103 |
| 4,777,754 | 10/1988 | Reynolds, Jr. | 42/103 |
| 4,876,816 | 10/1989 | Triplett | 42/103 |
| 4,894,941 | 1/1990 | Karow, Jr. | 42/103 |
| 5,033,219 | 7/1991 | Johnson et al. | 42/103 |
| 5,052,801 | 10/1991 | Downes, Jr. et al. | 356/153 |
| 5,064,988 | 11/1991 | E'nama et al. | 219/121.6 |
| 5,092,071 | 3/1992 | Moore | 42/85 |
| 5,107,612 | 4/1992 | Bechtel | 42/103 |

*Primary Examiner*—Michael J. Carone
*Assistant Examiner*—Matthew J. Lattig
*Attorney, Agent, or Firm*—Phillips, Lytle, Hitchcock, Blaine & Huber

[57] ABSTRACT

A universal tactical mount (10) is adapted to attach to a firearm barrel (18) and to have a plurality of firearm accessories (41, 42 and 43) mounted to it. The universal tactical comprises a plate (11) divided into an upper portion (12) and a lower portion (13) and an opening (16) on the boundary between the portions sized to tightly circumscribe the firearm barrel, thus fixedly mounting the universal tactical mount to the firearm. The plate further includes at least one mounting station (30, 31 and 32) adapted to fixedly hold a firearm accessory, such as a light source (e.g., laser, visible light or infra-red).

17 Claims, 7 Drawing Sheets

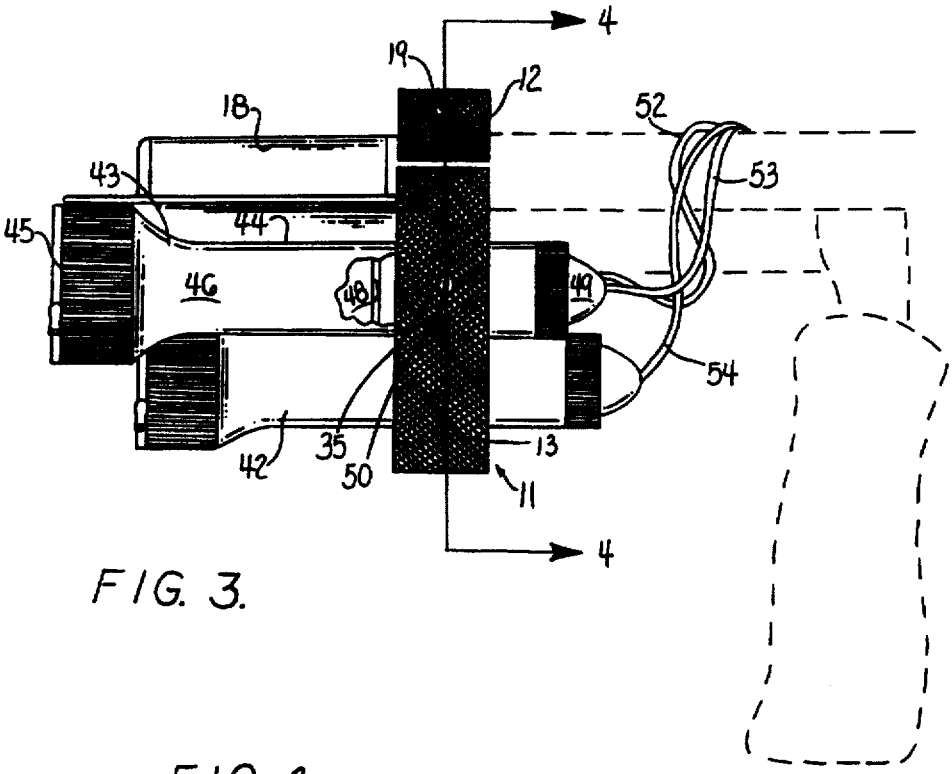
FIG. 3.
FIG. 4.
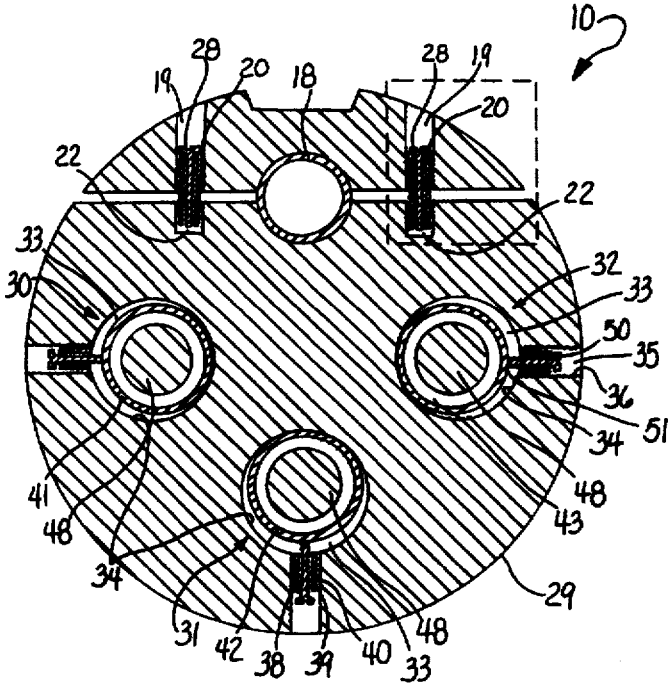
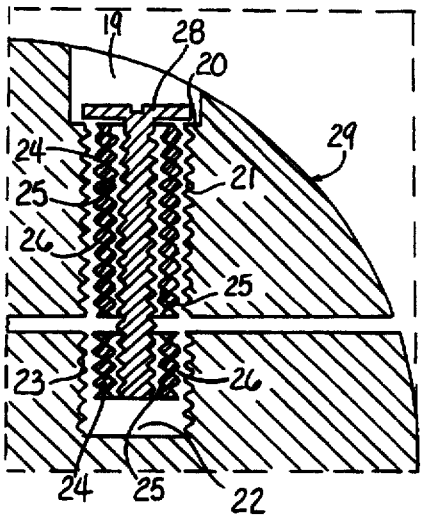
FIG. 5.

UNIVERSAL TACTICAL MOUNT

This application is a continuation-in-part of application Ser. No. 08/636,035, filed on Apr. 22, 1996, now abandoned.

TECHNICAL FIELD

The invention relates to firearms, and, more particularly, to a unique device mounted to the barrel of a firearm to which a plurality of accessories may be fixedly mounted that dissipates heat generated by the operation of the firearm.

BACKGROUND

It is well known in the prior art to mount accessories to firearms. Accessories can increase the effectiveness, utility and power of the firearm. Commonly mounted accessories include telescopic sights, bayonets, grenade launchers and electromagnetic radiation emitters (e.g., light sources).

The integration of light sources (e.g., visible, infra-red and laser) to firearms has proven especially helpful in many situations. A visible light source mounted to a firearm increases safety when operating in the dark. In addition, a visible light source may be mounted to a firearm such that the firearm and light aim in the same direction to illuminate the chosen target area.

However, different wave lengths of electromagnetic radiation used in conjunction with a firearm can accomplish different tasks. For instance, an infra-red source (a source emitting at a wave length between 0.75 microns and 1000 microns), used in conjunction with a screen or goggles specially designed to translate infra-red into signals visible to humans, can provide greater awareness of ones surroundings without using visible light, which make the location of the user known. In addition, it is well known that a laser beam of visible light is an excellent sighting system for firearms. A visible laser beam, correctly mounted to a firearm will project a thin beam over a great distance without dissipation to indicate where the firearm is aimed.

Many times, multiple types of light sources or other accessories are useful concurrently. The present invention provides a device adapted to connect to the barrel of a firearm to which a plurality of accessories, including light sources, may be fixedly mounted and operated simultaneously without interfering with one another or the firearm.

A separate challenge facing users of a laser beam device mounted to a firearm is the tendency for heat generated by the firearm to alter the aim of the laser beam from its calibrated setting. Even slight alterations can translate to significant targeting error over a distance. The heat generated from the operation of the firearm transfers from the firearm barrel to the mount for the laser beam device and the casing of the laser beam device. This heat can then alter the aim of the laser beam device. The present invention provides a mount to efficiently dissipate heat generated by the operation of the firearm.

BRIEF DESCRIPTION OF THE INVENTION

With parenthetical reference to the corresponding parts, portions and surfaces of the disclosed embodiment, merely of purposes of illustration and not by way of limitation, the present invention provides, in one aspect, a unique universal tactical mount (10) which is mounted to a firearm barrel (18) and to which firearm accessories (41, 42 and 43) are mounted. The universal tactical mount comprises a plate (11) having a first opening (16) adapted to tightly circumscribe a firearm barrel and comprised of two-semi-cylindrical openings, (14 and 15). Plate (11) comprises an upper portion (12) and a lower portion (13), the boundary between these two portions is in part the boundary between the semi-cylindrical openings. The upper and lower portions are held together by screws (28). The universal tactical mount further comprises a plurality of mounting stations (30, 31 and 32). Each mounting station is configured to fixedly hold a firearm accessory (41, 42 and 43) such that the accessories do not interfere with one another or the weapon. In one embodiment, each mounting station includes an opening (33) defined by a surface (34), a through bore (35), having a tapped surface (36) which-extends between the surface of the mounting station opening and the exterior axial surface of the plate (29), and a helicoil (38), which has a tapped interior surface (39) and exterior surface (40). The accessory is positioned within the mounting station opening. A set screw (50) is threaded into the through bore until it fixedly presses the accessory against the mounting station opening surface.

In another embodiment of the invention, the unique universal tactical mount (110) is mounted to a firearm barrel (117). The second universal tactical mount has a front face (111), a rear face (112) and an outer periphery surface (113) joining the front and rear faces. The plate is divided into an upper portion (114), middle portion (115) and lower portion (116). A plurality of fins (129) extend radially from the outer periphery surface, and a plurality of throughbores (130) are present between the front and rear faces. A first opening (118) between the front and rear faces along the boundary (119) between the upper and middle portions is configured to circumscribe the barrel of a firearm. A second opening (122) between the front and rear faces along the boundary (123) between the middle and lower portions is configured to circumscribe an electromagnetic radiation emitting device. In addition, mounting stations (126, 128) one present on the middle portion adapted to fixedly hold a firearm accessory. A throughbore can be lined with a hollow sleeve (131) made of a thermally conductive material. At least one end of the sleeve extends past either the front or the rear face to increase the heat transfer. Alternatively, throughbore could be occupied by a solid member (133) made of a thermally conductive material. Again, one end of said solid member would extend beyond either the front or rear face of the plate to increase heat transfer.

Accordingly, the general object of the invention is to provide a device to which a plurality of firearm accessories may be mounted.

Another object is to provide a universal tactical mount to which firearm accessories may be mounted such that they do not interfere with one another or the weapon during the operation.

Another object is to provide a universal tactical mount for firearm accessories designed to efficiently transfer heat generated by the operation of the firearm away from the firearm accessories.

These and other objects and advantages will become apparent from the foregoing and ongoing written specification, the drawings and the appended claims.

DESCRIPTION OF THE DRAWINGS

FIG. 3 is a fragmentary side elevation, partially in section, of a firearm embodying the invention.

FIG. 4 is a sectional view taken along line 44 of FIG. 3.

FIG. 5 is an enlargement of the dashed line box in FIG. 4.

DESCRIPTION OF THE PREFERRED EMBODIMENT

Figure 1:
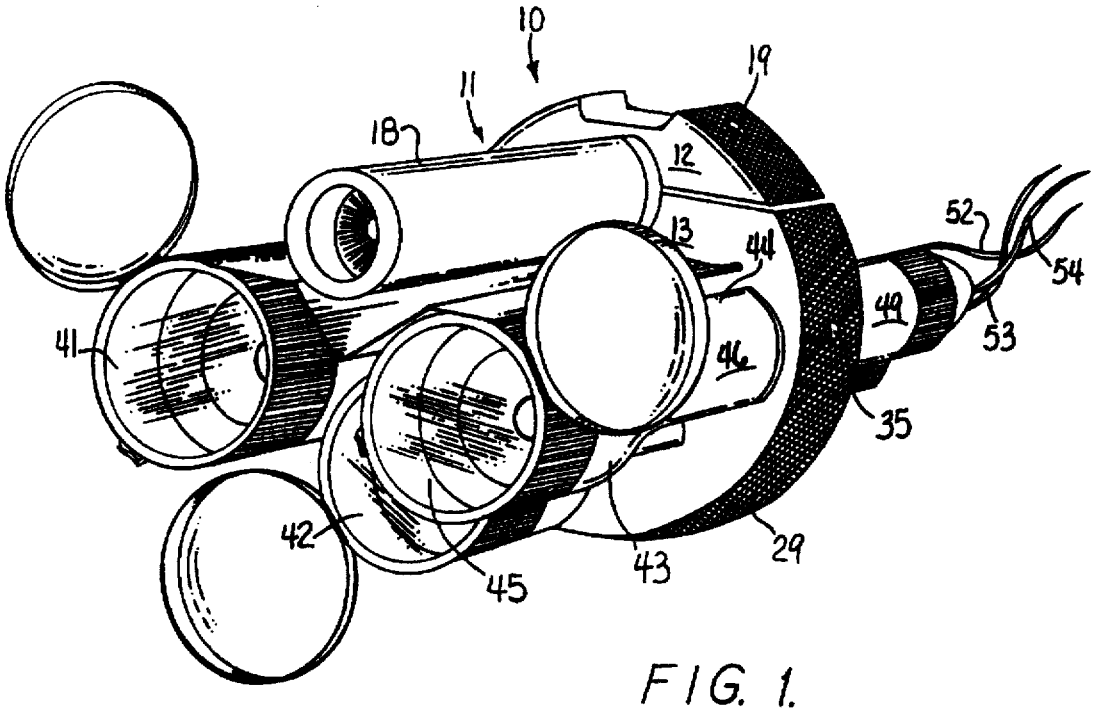
FIG. 1 is a fragmentary prospective view of a firearm embodying the invention.

At the outset, it should be clearly understood that like reference numerals are intended to identify the same structural elements, portions or surfaces consistently throughout the several drawing figures, as such element, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.) simply refer to the orientation of the illustrated structure as the particular drawing figure faces the reader. Similarly, the terms "inwardly" and "outwardly" generally refer to the orientation of a surface relative to its axis of elongation, or axis of rotation as appropriate.

Figure 2:
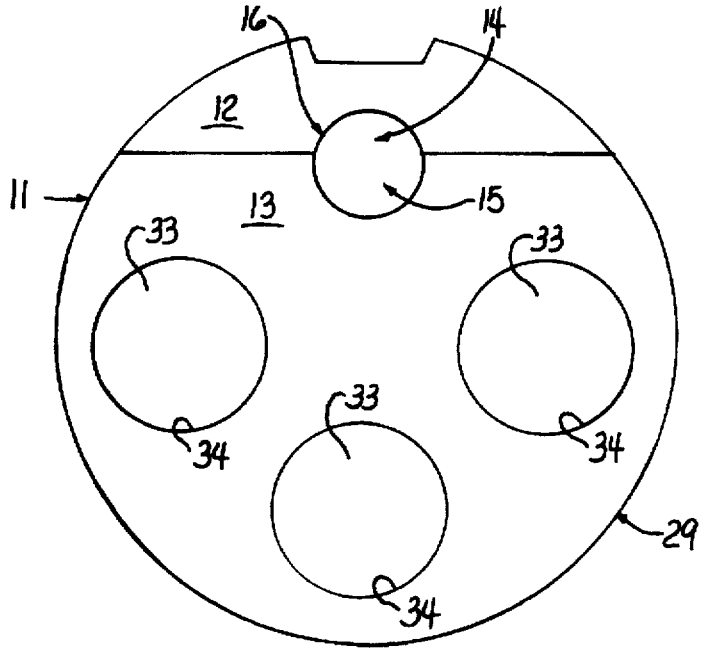
FIG. 2 is a front elevation of the invention.

Adverting to FIGS. 1 and 2, the invention is a universal tactical mount 10 comprising a circular plate 11 split into an upper portion 12 and a lower portion 13. Portions 12 and 13 each include a semi-cylindrical opening, indicated at 14 and 15 respectively. Plate 11 is made of relatively thin 6061 T6 aluminum stock, a light-weight but strong alloy.

A first circular opening 16 is formed by semi-cylindrical openings 14 and 15, which register. Opening 16 is adapted to circumscribe the end of a barrel 18 to a chosen firearm. Barrel 18 fits tightly into opening 16, thus preventing plate 11 from slipping along or rotating about barrel 18. This is important as an accessory will be calibrated for proper operation after it is mounted to plate 11. For example, a laser source mounted to plate 11 will become inaccurate if plate 11 shifts after calibration.

This tight fit about barrel 18 is accomplished by tightly connecting portions 12 and 13. FIG. 4 and 5 show the bore-and-screw system used in the preferred embodiment. Space has been added between the portions of the bore-and-screw system for clarity. Two through bores 19 are located in portion 12, one on either side of semi-cylindrical opening 14. Each bore 19 has a radially and inwardly extending shoulder, severally indicated at 20. In addition, below each shoulder 20 is an inwardly-facing threaded cylindrical surface 21.

A blank bore 22 in lower portion 13 registers with each bore 19. Each bore 22 is bounded by a tapped surface 23. Surfaces 21 and 23 are lined with a separate stainless steel helicoils, severally indicated at 24. Helicoils 24 have an internal threaded surface 25 and external threaded surface 26. Surface 26 is adapted to mate with either tapped surface 21 or 23. Helicoils 24 increase the strength of bore surfaces 21 and 23. Portions 12 and 13 are fixedly connected by threading screws, severally indicated at 28, through bore 19 and into bore 22 along threads 25 of helicoils 24. When the head of screw 28 contacts flange 20, further rotation of screw 28 draws portions 12 and 13 together into a tight fit about barrel 18.

It is contemplated that portions 12 and 13 may be fixedly connected in other ways. For example, latches (not shown) mounted the exterior axial surface 29 of upper portion 12 adapted to grasp and tighten to protrusions on exterior axial surface 29 at lower portion 13 could be used. Similarly, a hinge (not shown) placed on the exterior axial surface 29 of plate 11 connecting portions 12 and 13 in conjunction with a single latch (not shown) opposite the hinge could also fixedly connect portions 12 and 13. The multiple-latch and latch-and-hinge connecting systems are examples of the many ways portions 12 and 13 could be connected as contemplated by the invention.

It is an object of the invention to mount firearm accessories to universal tactical mount 10 so that they do not interfere with barrel 18 or each other. This is accomplished by spacing each accessory distant from one another and from barrel 18 using a system of mounting stations.

As best shown in FIGS. 1–4, the preferred embodiment of lower plate 13 includes three mounting stations 30, 31 and 32. The invention teaches the use of at least one mounting station. Plate 11 could have a greater or lesser number of mounting stations depending on the size of plate 11 and the accessories to be mounted. Each mounting station in the preferred embodiment includes an opening 33 bounded by a surface 34, a through bore 35, having a tapped surface 36, and which extends between surface 34 and exterior axial surface 29 of plate 11. A helicoil 38 having internal threaded surface 39 and external threaded surface 40 adapted to mate with tapped surface 36 is mounted within bore 35 on threaded surface 40. FIGS. 1 and 4 show a visible light source 41 .at mounting station 30, a laser source 42 at mounting station 31 and an infra-red source 43 at mounting station 32.

Each opening 33 is circular having a diameter larger than that of common personal light sources. Thus, specially configured light sources are not required. Traditionally, personal light sources have taken the shape of a flashlight. For example, FIG. 3 shows infra-red source 43 comprises a cylindrical body 44 having an infra-red emitter 45 at a first end 46 and room for power storage (e.g., batteries 48) at a second end 49. However, the exterior diameter of personal light sources varies. Accordingly, opening 33 is intentionally larger than the diameter of commonly available personal light sources.

Adverting now to FIG. 4, to fixedly connect infra-red source 43, or any other personal light source, to a mounting station, second end 49 is placed through an opening 33 until the pivot point of the infra-red source 43 is between the surfaces of plate 11. This eliminates or reduces rotational forces acting on infra-red source 43 that could misalign it after mounting. When infra-red source 43 is in the desired position, set screw 50 is threaded through bore 35 along internal surface 39 of helicoil 38 until end 51 firmly presses infra-red source 43 against surface 34.

As can be seen in FIGS. 1 and 3, cables 52, 53 and 54 run from the light sources back towards the stock of the fiream (not shown) where they connect to a controller (not shown) which can be operated to control each light source. This allows control of the accessories connected to universal tactical mount 10 without moving the firearm from a "ready" position.

Figure 6:
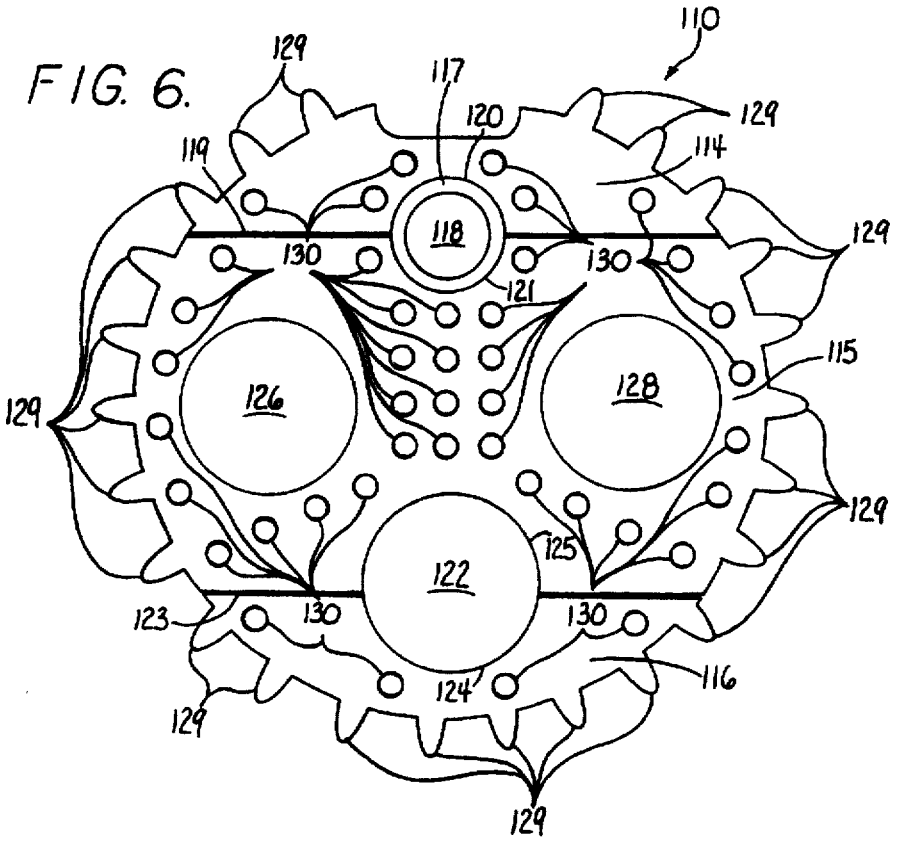
FIG. 6 is a front elevation of a second embodiment of the invention.
Figure 7:
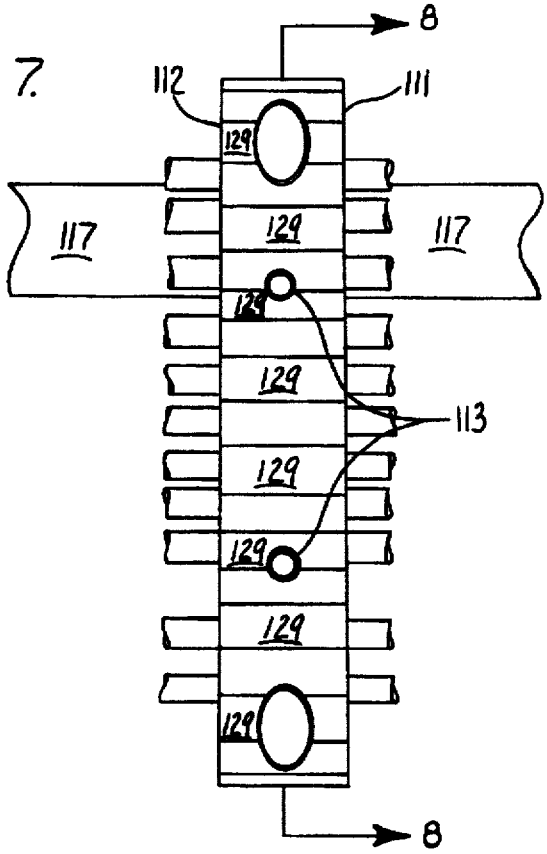
FIG. 7 is a side view of a second embodiment of the invention.

Adverting now to FIGS. 6 and 7, a second embodiment of the universal tactical mount 110 is shown. Universal tactical mount 110 has a front face 111 and a rear face 112 connected by an outer periphery surface 113. Universal tactical mount 110 includes three portions: an upper portion 114, a middle portion 115 and a lower portion 116. Upper, middle and lower portions 114, 115 and 116 can be made of any strong, lightweight nondeformable material. Here, all three are made of relatively thin 6061 T6 aluminum stock.

Similar to universal tactical mount 10, universal tactical mount 110 includes a first opening 118 between front face 111 and rear face 112 along the boundary 119 between upper plate 114 and middle plate 115. Opening 118 comprises two registering concave semicircular surfaces 120 and 121 which extend into upper portion 114 and middle portion 115, respectively. Universal tactical mount 110 also includes a second opening 122 between front surface 111 and rear surface 112 along the boundary 123 between middle portion 115 and lower portion 116. Second opening 122 comprises two registering concave semicircular surfaces 124 and 125 which extend into lower portion 116 and middle portion 115, respectively. Opening 118 is configured to receive the barrel of a chosen firearm 117. Opening 122 is configured to receive an electromagnetic radiation device. Here, opening 122 is specifically configured to accept the shaft of a laser beam device (not shown) used for aiming.

Middle portion 115 includes two openings 126, 128 between front surface 111 and rear surface 112 configured to be mounting stations for a variety of electromagnetic radiation devices, such as flashlights or infra-red sources. Openings 126 and 128 are identical to openings 33 of universal tactical mount 10.

Universal tactical mount 110 further includes a plurality of fins, severally indicated at 129, extending from outer periphery surface 113 between front face 111 and rear face 112 and a plurality of throughbores, severally indicated at 130, between front surface 111 and rear surface 112. Fins 129 and throughbores 130 increase the capacity of universal tactical mount 110 to dissipate heat generated by the operation of a firearm. As the temperature of firearm barrel 117 increases during operation, heat will transfer by conduction into the portion of universal tactical mount 110 immediately adjacent firearm barrel 117 by conduction. As this heat reaches a throughbore 130, convection heat transfer by air traveling through that throughbore 130 will increase the rate at which heat is dissipated from universal tactical mount 110. The heat from firearm barrel 117 will also reach outer periphery surface 113 and fins 129. Fins 129 are particularly designed to increase the rate at which heat is dissipated from universal tactical mount 110.

It is important to dissipate heat generated by firearm barrel 117. An increase in temperature of a laser beam device can alter the aiming of its laser beam. Accordingly, the pattern of throughbores 130 is concentrated around opening 118 and between opening 118 and opening 122. Making the most direct path between firearm barrel 117 and a laser beam aiming device held in opening 124 the path of greatest heat dissipation.

Figure 9:
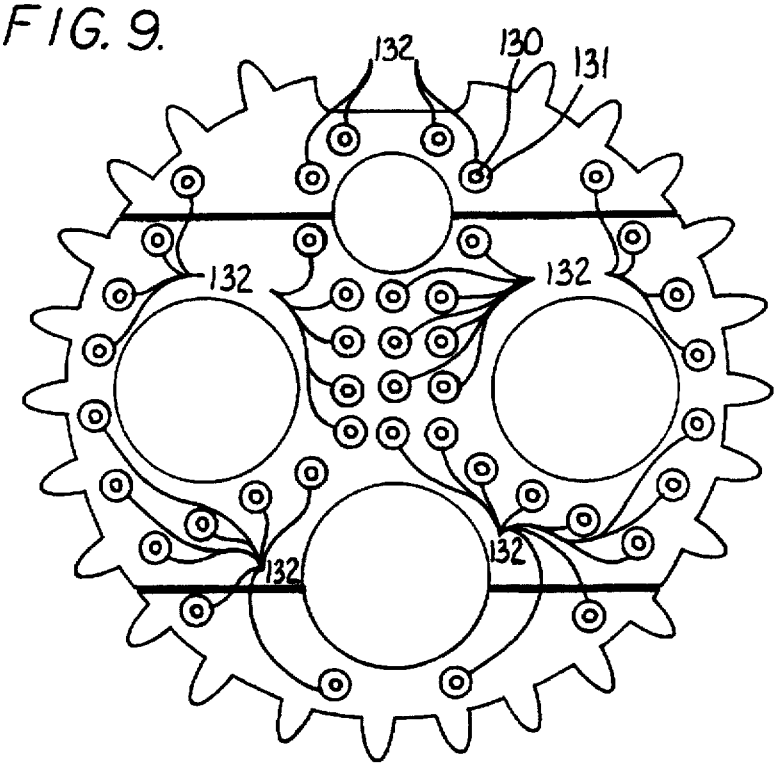
FIG. 9 is similar to FIG. 6 with the addition of hollow sleeves.
Figure 10:
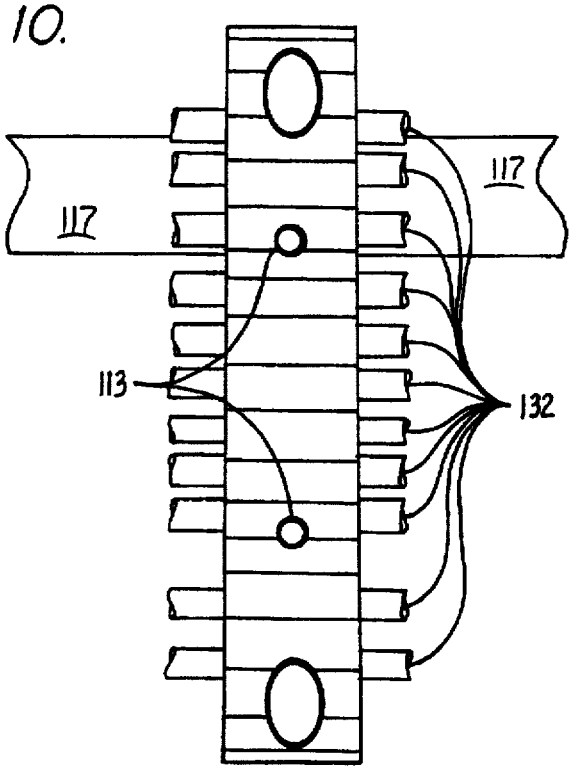
FIG. 10 is a side view of FIG. 9.

The invention also contemplates increasing the heat transfer rate of throughbores 130 by the addition of either a sleeve or solid member. Adverting now to FIGS. 9 and 10, universal tactical mount 110 is shown having each throughbore 130 occupied by hollow sleeve, severally indicated at 131, extending beyond both front face 111 and rear face 112. Each throughbore 130 and hollow sleeve 131 pair form a throughbore/hollow sleeve assembly 132. Hollow sleeve 131 is made of a highly thermally conductive material and, in effect, creates a hollow thermal fin at each throughbore 130. The hollow nature of sleeve 131 allows for increased convection heat transfer by airflow through sleeve 131.

Figure 11:
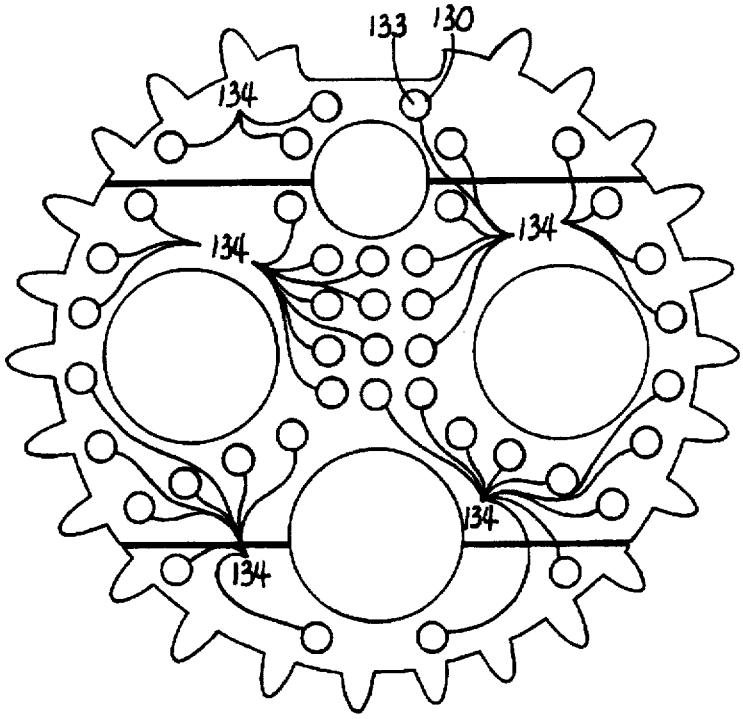
FIG. 11 is similar to FIG. 6 with the addition of solid members.
Figure 12:
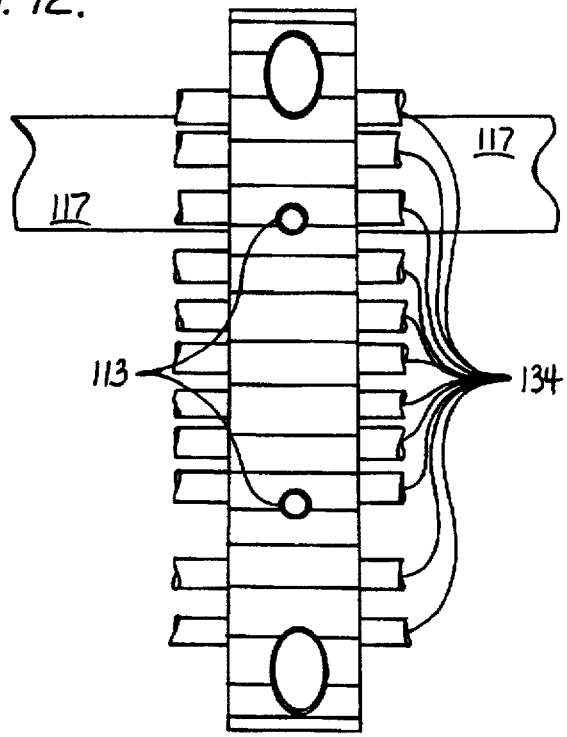
FIG. 12 is a side view of FIG. 11.

Adverting now to FIGS. 11 and 12, universal tactical mount 110 is shown having a solid member, severally indicated at 133, occupying each throughbore 130. Each solid member 133 is made of a highly thermally conductive material, such as cooper. Each throughbore 130 and member 133 pair form a throughbore/member assembly 134.

Figure 8:
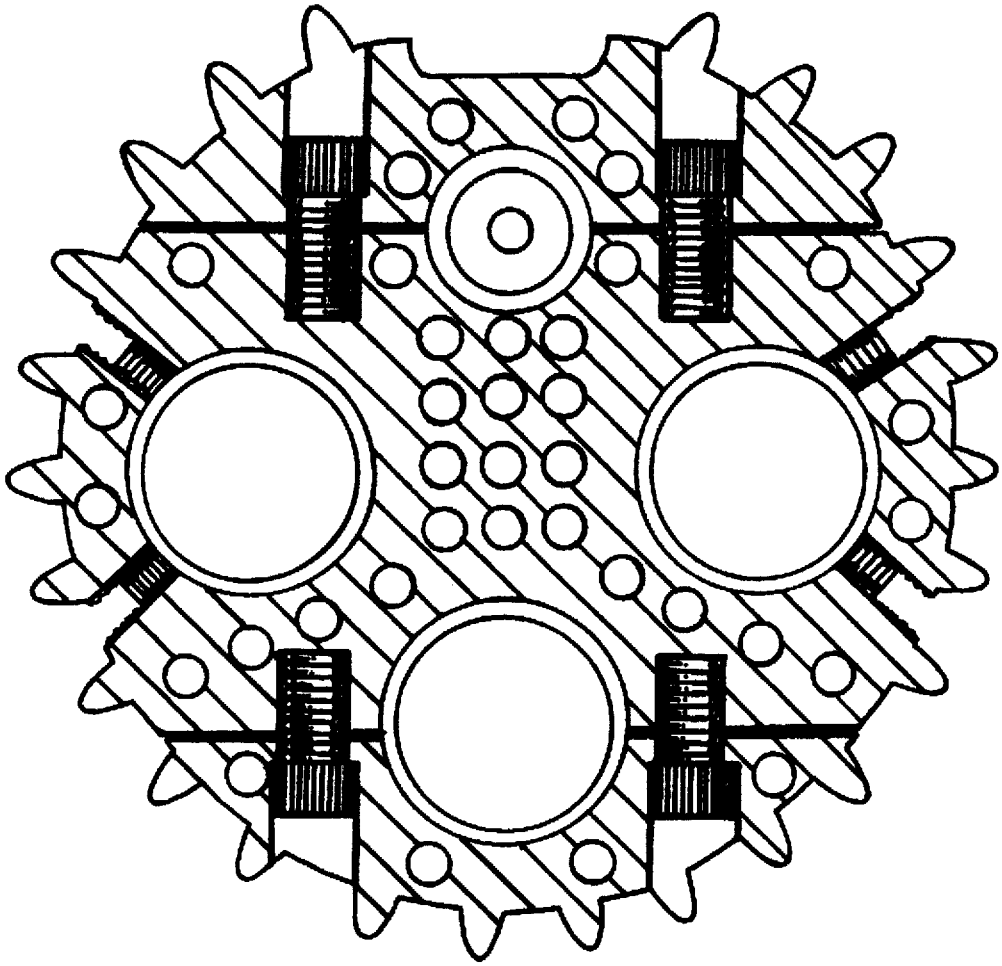
FIG. 8 is a sectional view of FIG. 7 taken along line 8—8.

Adverting now to FIG. 8, the connection between the upper portion 114 and middle portion 115 is seen to be the same as the connection between upper portion 12 and lower portion 13 of universal tactical mount 10 and described in greater detail earlier. Universal tactical mount 110 also uses this connection system between middle portion 115 and lower portion 116.

FIG. 8 also shows the use of two set screws 135 to secure a firearm accessory held within either opening 126 or 128. The use of two set screws in comparison to one set screw as shown with universal tactical mount 10 provides greater stability.

Figure 13:
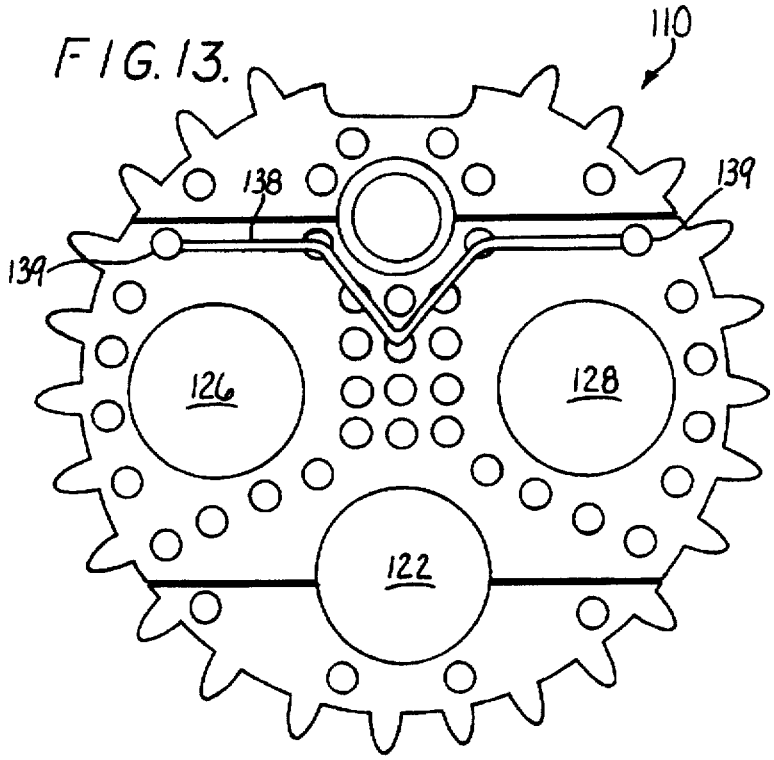
FIG. 13 is similar to FIG. 11 with the addition of flash guard.
Figure 14:
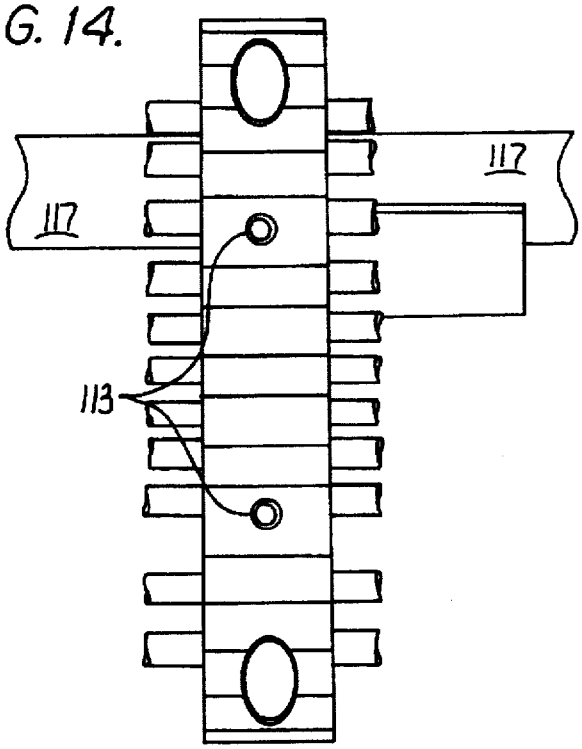
FIG. 14 is a side view of FIG. 13.

FIGS. 13 and 14 show the incorporation of a flash guard 138 to universal tactical mount 110. As shown in FIG. 13 flash guard 138 is an inverted gull-wing metal plate fixedly mounted to cylinders 139. Alternatively, flash guard 138 could be mounted to solid members at its ends. Flash guard 138 protects the optics of firearm accessories mounted in mounting stations 126, 128 and second opening 122 from combustion residue forced from the end of firearm barrel 117. It is known that combustion residue collecting on the lenses of optical firearm accessories can degrade their performance.

MODIFICATIONS

The present invention contemplates various changes and modifications may be made. For example, a tab-and-slot system could be utilized to connect accessories to plate 11. That is, tabs on the outer surface of an accessory could register with slots normal to surface 34. Once the tabs pass through the slot, the accessory is twisted, locking the tabs into place between the surfaces of plate 11. Moreover, a mounting station need not include an opening through plate 11. An end surface of an accessory could include one half of a latch system adapted to mate with a mounting station including the other half of the latch system.

It is also contemplated that universal tactical mount 10 need not be limited to use only with light sources. The invention contemplates holding other firearm accessories, for example, small cameras and motion sensors.

It is also contemplated that a combination of throughbore/hollow sleeve assemblies and throughbore/member assemblies can be used to customize the heat distribution and heat dissipation characteristics of the universal tactical mount.

Therefore, while the presently-preferred embodiment of the universal tactical mount has been shown and described, and several modifications thereof discussed, persons skilled in the an will appreciate that various additional changes and modifications may be made without departing from the spirit of the invention as defined and differentiated by the following claims.

I claim:

1. Universal tactical mount for holding and aiming accessories for a firearm, comprising:

a plate having a front face, a rear face and an outer periphery surface joining said front and rear faces, said plate further having an upper portion, middle portion and lower portion, each made of a thermally conductive material;

a plurality of fins extending radially from said outer periphery surface;

a plurality of throughbores between said front and rear faces;

a first opening between said front and rear faces along the boundary between said upper and middle portions configured to circumscribe the barrel of a firearm;

a second opening between said front and rear faces along the boundary between said middle and lower portions configured to circumscribe an electromagnetic radiation emitting device; and at least one mounting station on said plate, said mounting station adapted to fixedly hold a firearm accessory.

2. The universal tactical mount as set forth in claim 1 wherein each said throughbore is lined with a hollow sleeve made of a thermally conductive material to compose a throughbore/hollow sleeve assembly, each said sleeve extending beyond at least one of said front or rear faces.

3. The universal tactical mount as set forth in claim 1 wherein each said throughbore is occupied by a solid member made of a thermally conductive material to compose a throughbore/member assembly, each said member extending beyond at least one of said front or rear faces.

4. The universal tactical mount as set forth in claim 1 wherein said throughbores are concentrated about said first opening whereby the ability of said throughbores to dissipate heat received from said firearm barrel is increased.

5. The universal tactical mount as set forth in claim 2 wherein said throughbore/hollow sleeve assemblies are concentrated about said first opening whereby the heat dissipation from said universal tactical mount is enhanced.

6. The universal tactical mount as set forth in claim 3 wherein said throughbore/member assemblies are concentrated about said first opening whereby the heat dissipation from said universal tactical mount is enhanced.

7. The universal tactical mount as set forth in claim 1 wherein said electromagnetic radiation emitting device emits a laser beam and said mounting station is an opening between said front and rear faces, and said firearm accessory is an electromagnetic radiation device emitting visible light.

8. The universal tactical mount as set forth in claim 2 wherein said electromagnetic radiation emitting device emits a laser beam and said mounting station is an opening between said front and rear faces, and said fiream accessory is an electromagnetic radiation device emitting visible light.

9. The universal tactical mount as set forth in claim 3 wherein said electromagnetic radiation emitting device emits a laser beam and said mounting station is an opening between said front and rear faces, and said firearm accessory is an electromagnetic radiation device emitting visible light.

10. The universal tactical mount as set forth in claim 1 wherein said electromagnetic radiation emitting device emits a laser beam, said mounting station is an opening between said front face and rear face, and said firearm accessory is an electromagnetic radiation device emitting infra-red radiation.

11. The universal tactical mount as set forth in claim 2 wherein said electromagnetic radiation emitting device emits a laser beam, said mounting station is an opening between said from face and rear face, and said firearm accessory is an electromagnetic radiation device emitting infra-red radiation.

12. The universal tactical mount as set forth in claim 3 wherein said electromagnetic radiation emitting device emits a laser beam, said mounting station is an opening between said front face and rear face, and said firearm accessory is an electromagnetic radiation device emitting infra-red radiation.

13. The universal tactical mount as set forth in claim 1 wherein said upper portion has at least one upper portion bore between said outer periphery surface and said boundary with said middle portion that registers with a first internally threaded blank bore in said middle portion, and said lower portion has at least one lower portion bore between said outer periphery surface and said boundary with said middle portion that registers with a second internally threaded blank bore in said middle portion, said upper portion and lower portion bores configured such that a screw may proceed through each and into said registering blank bore to fixedly hold said upper, middle and lower portions together.

14. The universal tactical mount as set forth in claim 2 wherein said upper portion has at least one upper portion bore between said outer periphery surface and said boundary with said middle portion that registers with a first internally threaded blank bore in said middle portion, and said lower portion has at least one lower portion bore between said outer periphery surface and said boundary with said middle portion that registers with a second internally threaded blank bore in said middle portion, said upper portion and lower portion bores configured such that a screw may proceed through each and into said registering blank bore to fixedly hold said upper, middle and lower portions together.

15. The universal tactical mount as set forth in claim 3 wherein said upper portion has at least one upper portion bore between said outer periphery surface and said boundary with said middle portion that registers with a first internally threaded blank bore in said middle portion, and said lower portion has at least one lower portion bore between said outer periphery surface and said boundary with said middle portion that registers with a second internally threaded blank bore in said middle portion, said upper portion and lower portion bores configured such that a screw may proceed through each and into said registering blank bore to fixedly hold said upper, middle and lower portions together.

16. The universal tactical mount as set forth in claim 1 wherein said upper, middle and lower portions are adapted to separate from one another.

17. The universal tactical mount as set forth in claim 3 further comprising a flash guard mounted on said middle portion below said first opening and above said second opening and said mounting station.

* * * * *